US011462189B2

(12) United States Patent
Wu et al.

(10) Patent No.: US 11,462,189 B2
(45) Date of Patent: Oct. 4, 2022

(54) DRIVING CIRCUIT AND DRIVING METHOD FOR DISPLAY PANEL AND DISPLAY MODULE

(71) Applicant: Sitronix Technology Corp., Hsinchu County (TW)

(72) Inventors: Kai-Yi Wu, Hsinchu County (TW); Yun-Chu Chen, Hsinchu County (TW); Li-Yu Huang, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 0 days.

(21) Appl. No.: 17/017,704

(22) Filed: Sep. 11, 2020

(65) Prior Publication Data

US 2021/0241712 A1 Aug. 5, 2021

Related U.S. Application Data

(60) Provisional application No. 62/898,553, filed on Sep. 11, 2019.

(51) Int. Cl.
*G09G 3/36* (2006.01)

(52) U.S. Cl.
CPC ..... *G09G 3/3696* (2013.01); *G09G 3/3648* (2013.01); *G09G 3/3674* (2013.01); *G09G 3/3685* (2013.01); *G09G 2300/0426* (2013.01); *G09G 2310/08* (2013.01); *G09G 2320/0247* (2013.01)

(58) Field of Classification Search
None
See application file for complete search history.

(56) References Cited

U.S. PATENT DOCUMENTS

| | | | | |
|---|---|---|---|---|
| 2005/0253799 | A1 | 11/2005 | Kamio | |
| 2006/0208985 | A1* | 9/2006 | Hwang | G09G 3/3655 345/92 |
| 2010/0123647 | A1* | 5/2010 | Goo | G09G 3/3648 345/55 |
| 2011/0128272 | A1 | 6/2011 | Chen | |
| 2018/0095573 | A1 | 4/2018 | Kwon | |

FOREIGN PATENT DOCUMENTS

| | | | |
|---|---|---|---|
| CN | 101201478 | A | 6/2008 |
| CN | 103295539 | A | 9/2013 |
| CN | 204029332 | U | 12/2014 |
| CN | 104698698 | A | 6/2015 |
| CN | 105976782 | A | 9/2016 |
| EP | 1 986 182 | A1 | 10/2008 |
| JP | 2013-246434 | A | 12/2013 |
| KR | 10-2013-0131808 | A | 12/2013 |
| TW | 201445383 | A | 12/2014 |

* cited by examiner

*Primary Examiner* — Christopher J Kohlman
(74) *Attorney, Agent, or Firm* — Winston Hsu

(57) ABSTRACT

A driving circuit for a display panel includes a common voltage generating circuit. The common voltage generating circuit is coupled to multiple common electrodes of the display panel and configured to provide multiple common voltages respectively to the common electrodes. During a frame period, the common voltage generating circuit respectively changes a voltage level of the common voltages at different time.

21 Claims, 9 Drawing Sheets

DRIVING CIRCUIT AND DRIVING METHOD FOR DISPLAY PANEL AND DISPLAY MODULE

CROSS REFERENCE TO RELATED APPLICATION

This application claims the benefit of U.S. Provisional Application No. 62/898,553 filed 2019 Sep. 11, the entirety of which is incorporated by reference herein.

BACKGROUND OF THE INVENTION

1. Field of the Invention

The invention relates to driving circuits and driving methods for a display panel and the associated display module, more particular to the driving circuits and driving methods capable of effectively mitigating screen flicker for a display panel and the associated display module.

2. Description of the Prior Art

Thin Film Transistor Liquid Crystal Display (TFT-LCD) is one of various liquid crystal displays. It uses the thin film transistor technology to improve image quality and is often used in TVs, flat panel displays and projectors.

In order not to affect the arrangement and transmittance of the liquid crystal molecules, and also to avoid the residual image caused by the direct current (DC) blocking effect of the alignment film and the DC residual, it is necessary to reverse the polarity of the electric field applied to the liquid crystal molecules, that is, to apply the electric field with an opposite direction to the liquid crystal molecules at different time.

Common polarity inversions include line inversion, dot inversion, frame inversion, etc. High power consumption is a problem of line inversion and dot inversion since frequent polarity inverse operation is required. As to the frame inversion, the polarity inverse operation is performed only once per frame. However, the brightness of the pixels will be affected by the existing parasitic effect on the display panel and leakage effect of the storage capacitor. The longer time the pixel waits to be enabled, the greater the amount of brightness change. When the frame inversion is applied, screen flicker will occur since a large amount of brightness change is generated on the pixels which wait for a long time to be enabled.

To solve this problem, a driving circuit and driving method capable of effectively mitigating screen flicker for a display panel and the associated display module are highly required.

SUMMARY OF THE INVENTION

It is an object of the invention to solve the problems of screen flicker and uneven brightness distribution of the display panel.

According to an embodiment of the invention, a driving circuit for a display panel comprises a common voltage generating circuit coupled to a plurality of common electrodes of the display panel and configured to provide a plurality of common voltages respectively to the common electrodes. During a frame period, the common voltage generating circuit changes a voltage level of the common voltages respectively at different time.

According to another embodiment of the invention, a driving method for driving a display panel comprises: respectively providing a plurality of common voltages to a plurality of common electrodes of a display panel; and changing a voltage level of the common voltages at different time during a frame period.

According to another embodiment of the invention, a display module comprises a display panel and a common voltage generating circuit. The display panel comprises a plurality of common electrodes. The common voltage generating circuit is coupled to the common electrodes and configured to provide a plurality of common voltages respectively to the common electrodes. During a frame period, the common voltage generating circuit changes a voltage level of the common voltages respectively at different time.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, various embodiments of the invention will be illustrated with drawings to describe the invention in detail. However, the concept of the invention may be embodied in many different forms, and should not be interpreted as being limited to the exemplary embodiments set forth herein.

Certain terminologies are used in the specification and the claims to refer to specific components. However, those with ordinary skill in the art should understand that manufacturers may use different terminologies to refer to the same component. Moreover, the specification and the claims do not use the difference in names as a way to distinguish components, but use the overall technical difference of the components as a criterion for distinguishing the components. The word "comprise/comprising" in the specification and the claims is an open term, and should be interpreted as "comprise but not limited to". Furthermore, the term "coupled/coupling" used here includes any direct and indirect connection means. Therefore, if "a first device coupled to a second device" is described in the specification, it means that the first device can be directly connected to the second device, or can be indirectly connected to the second device through other devices or other connection means.

Figure 1:
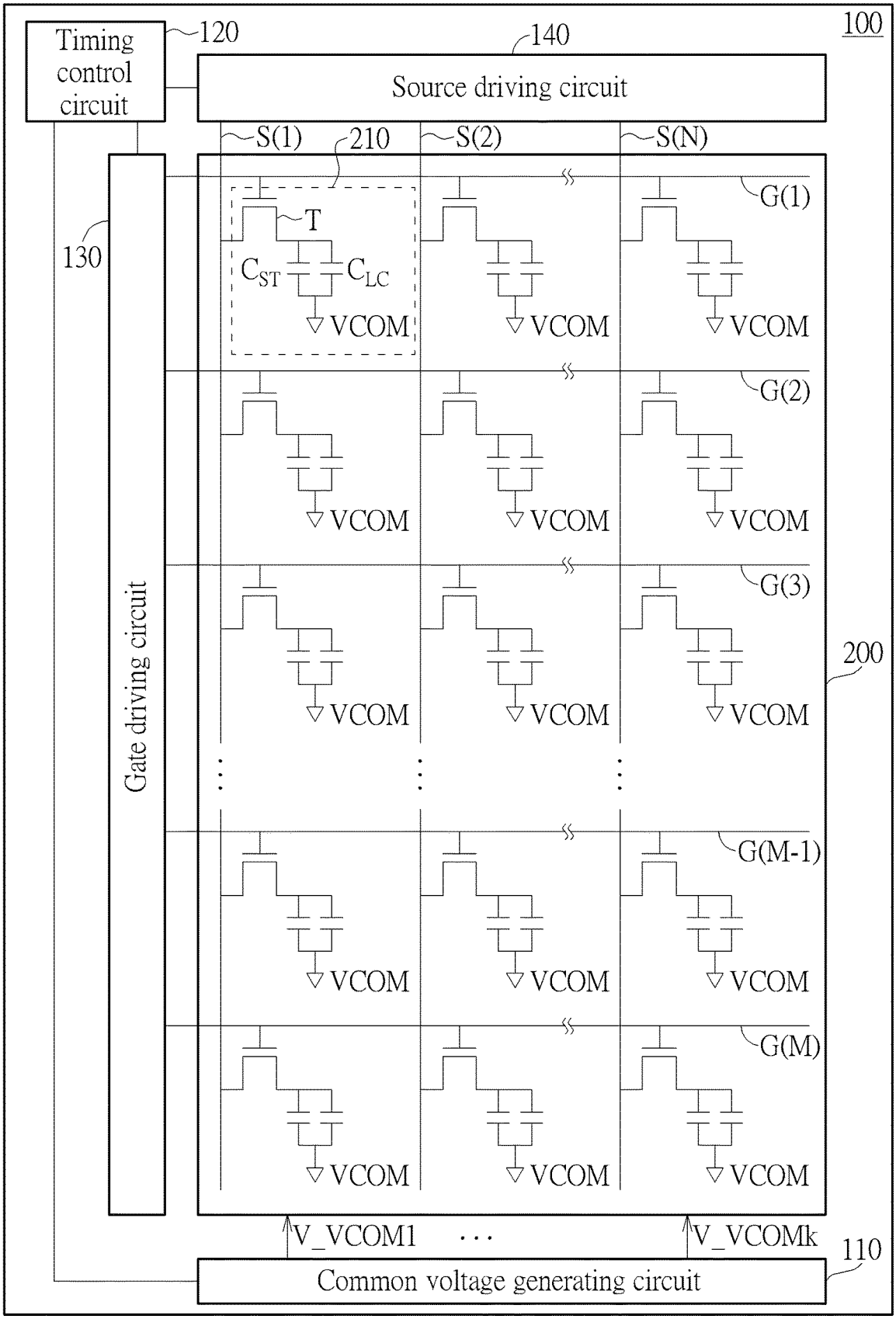
FIG. 1 shows a block diagram of a display module according to an embodiment of the invention.

FIG. 1 shows a block diagram of a display module according to an embodiment of the invention. The display module 100 comprises a display panel 200 and the driving circuit of the display panel. The driving circuit of the display panel is coupled to the display panel 200, for driving the display panel 200. The display panel 200 comprises a plurality of common electrodes and a plurality of pixel structures, for example, the pixel structure 210. Each pixel structure 210 comprises a transistor T, a liquid crystal capacitor $C_{LC}$ and a storage capacitor $C_{ST}$, and is coupled to one of the plurality of common electrodes. Since the plurality of common electrodes may have various different configurations in the embodiments of the invention, the common electrodes are collectively labeled as VCOM in FIG. 1 as a common representation. In addition, the display panel 200 has a plurality of gate lines and a plurality of source lines. Each pixel structure 210 may be respectively coupled to one gate line and one source line. For example, one of the gate lines G(1)~G(M) and one of the source lines S(1)~S(N), where M and N are respective a positive integer.

The driving circuit of the display panel comprises a common voltage generating circuit 110, a timing control circuit 120, a gate driving circuit 130 and a source driving circuit 140. In an embodiment of the invention, the driving circuit may be formed in an integrated circuit (IC). The common voltage generating circuit 110 is coupled to the plurality of common electrodes of the display panel 200 and configured to provide a plurality of common voltages, such as the common voltages V_VCOM1~V_VCOMk, respectively to the common electrodes, where k is a positive integer greater than 1. The gate driving circuit 130 is coupled to the gate lines G(1)~G(M) of the display panel 200 and configured to output a plurality of gate signals respectively to the gate lines. The source driving circuit 140 is coupled to a plurality of source lines S(1)~S(N) of the display panel 200 and configured to output a plurality of source signals respectively to the source lines S(1)~S(N).

The timing control circuit 120 is coupled to the common voltage generating circuit 110, the gate driving circuit 130 and the source driving circuit 140, and configured to generate a plurality of timing signals to the gate driving circuit 130, the source driving circuit 140 and the common voltage generating circuit 110, so that they may generate the corresponding signals according to the timing signals. For example, the timing control circuit 120 is configured to generate a clock signal or a start pulse and provide the clock signal or the start pulse to the gate driving circuit 130. The gate driving circuit 130 is configured to generate the gate signals according to the clock signal or the start pulse, for controlling the time for a level of each gate signal to be pulled high (an enable level) and pulled low (a disable level), and sequentially provide the gate signal to the corresponding gate line. The timing control circuit 120 is also configured to provide clock signal to the source driving circuit 140. The source driving circuit 140 is configured to generate a plurality of source signals according to the clock signal and pixel data, and sequentially provide the source signals to the corresponding source lines. In addition, the timing control circuit 120 is also configured to provide the clock signal to the common voltage generating circuit 110 and configured to control the common voltage generating circuit 110 to change the voltage level of the common voltages. For example, the common voltage generating circuit 110 is configured to control the time to change the voltage level of the common voltages according to the clock signal (which will be illustrated in more detailed in the following paragraphs). In an embodiment of the invention, some control parameters may be preset in the common voltage generating circuit 110. The common voltage generating circuit 110 may adjust the time to change the voltage level of the common voltages according to the control parameters, therefore does not need to be controlled by the timing control circuit 120. For example, the common voltage generating circuit 110 may comprise a counter which performs a counting operation and the common voltage generating circuit 110 may determine to adjust the time to change the voltage level of the common voltage according to the control parameters.

Figure 2:
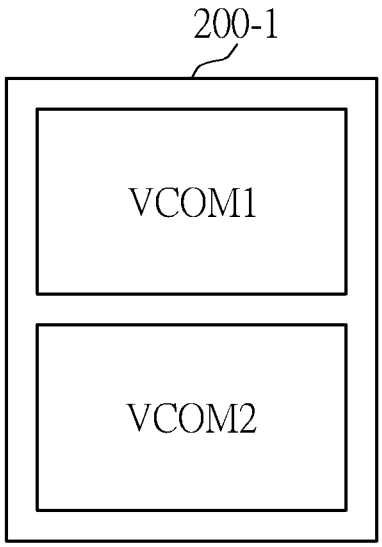
FIG. 2 is a schematic diagram showing the distribution of common electrodes according to an embodiment of the invention.

FIG. 2 is a schematic diagram showing the distribution of common electrodes according to an embodiment of the invention. In this embodiment, there are two common electrodes VCOM1 and VCOM2 in the display panel 200-1, and the common electrodes VCOM1 and VCOM2 are independent and disconnected from each other. The pixel structures of the display panel 200-1 are accordingly grouped into two pixel groups. The pixel structures in the first pixel group are coupled to the common electrode VCOM1 and the pixel structures in the second pixel group are coupled to the common electrode VCOM2. For example, the common electrode VCOM1 is distributed in the upper-half pixel area of the display panel 200-1 and the common electrode VCOM2 is distributed in the lower-half pixel area of the display panel 200-1. Therefore, the common electrode VCOM coupled to the pixel structures that are connected to the gate lines G(1)~G(M/2) in FIG. 1 may be the common electrode VCOM1 in FIG. 2, and the common electrode VCOM coupled to the pixel structures that are connected to gate lines G(M/2+1)~G(M) in FIG. 1 may be the common electrode VCOM2 in FIG. 2.

According to an embodiment of the invention, the common voltage generating circuit 110 may provide a plurality of common voltages respectively to the common electrodes of the display panel, and during a frame period, the common voltage generating circuit 110 changes a voltage level of the common voltages respectively at different time, to solve the aforementioned screen flicker problem.

Referring the embodiment shown in FIG. 2, in this application, the common voltages generated by the common voltage generating circuit 110 comprise the common voltages V_VCOM1 and V_VCOM2. The common voltage V_VCOM1 is provided to the common electrode VCOM1 and the common voltage V_VCOM2 is provided to the common electrode VCOM2. In addition, in this application, the gate lines in the display panel are grouped into a plurality of gate line groups, including a first gate line group and a second gate line group. The gate driving circuit 130 is configured to output a plurality of first gate signals to the gate lines in the first gate line group according to a first order and output a plurality of second gate signals to the gate lines in the second gate line group according to a second order. In the first embodiment of the invention, the first order is the same as the second order.

Figure 3:
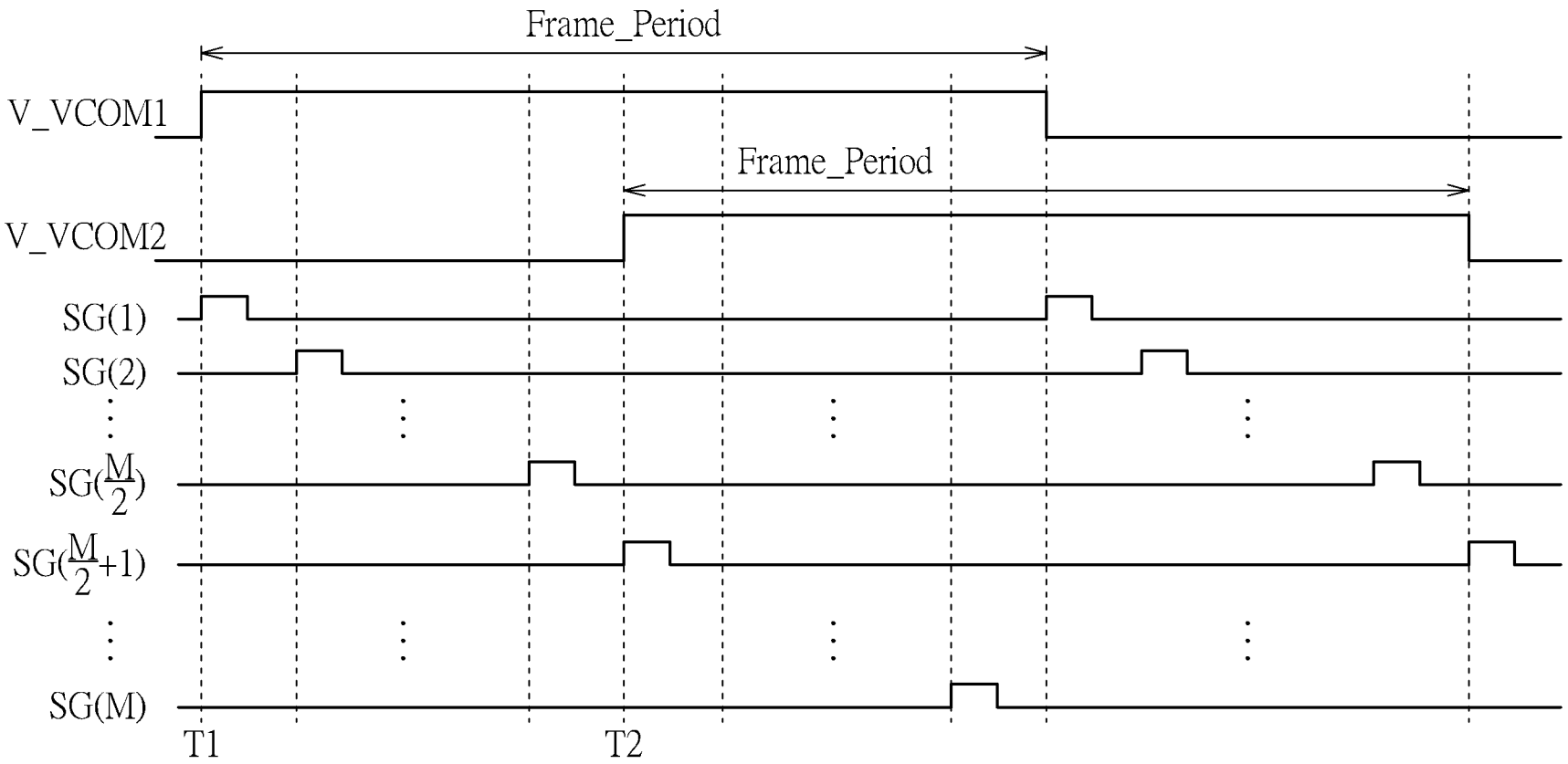
FIG. 3 is a diagram showing the timing of voltages and signals applied to the common electrodes showing in the FIG. 2 according to a first embodiment of the invention.

FIG. 3 is a diagram showing the timing of voltages and signals according to the first embodiment of the invention, which is the exemplary timing of the common voltages and the gate signals applied to the display panel having two common electrodes. The gate signals SG(1)~SG(M) are the gate signals respectively provided to the gate lines G(1)~G(M). As shown in the figure, in a frame period Frame_Period, which is the time period for completely displaying a picture on a screen, the common voltage generating circuit 110 is configured to change the voltage level, for example, switch from low voltage level to high voltage level, of the common voltage V_VCOM1 at the first time T1, and configured to change the voltage level, for example, switch from low voltage level to high voltage level, of the common voltage V_VCOM2 at the second time T2, where the first time T1 is different from the second time T2.

In other words, in the embodiments of the invention, the common voltage generating circuit 110 is configured to change the voltage level of the common voltages V_VCOM1 and V_VCOM2 at different time, such that there is a predetermined time difference between the change time of the common voltages V_VCOM1 and V_VCOM2, and the predetermined time difference (that is, the time difference between the first time T1 and the second time T2) relates to the amount of the common voltages/common electrodes. For example, the larger the amount of common voltages is, the smaller the predetermined time difference will be. For another example, the predetermined time difference may be set to the value obtained by dividing the length of the frame period Frame_Period by the amount of the common voltages, or set to a value close to the aforementioned value or another value obtained by fine tuning the aforementioned value.

In the embodiments of the invention, by configuring multiple common electrodes and multiple common voltages and changing the voltage level of the common voltages at different time, the aforementioned screen flicker problem caused due to a large amount of brightness change generated on a portion of pixels which wait for a long time to be enabled may be solved or mitigated. The reason will be illustrated in the following paragraphs:

Suppose that the brightness that should be displayed by a pixel structure is X and the finally displayed brightness is the amount of brightness change caused by the aforementioned parasitic effect and leakage effect for a unit time difference from the time when the voltage level of the common voltage provided to the common electrode coupled to this pixel structure is changed to the time when this pixel structure is enabled (that is, the gate signal on the gate line coupled to this pixel structure is enabled) is Y, wherein the change of the common voltage level is to invert the polarity of the electric field applied to the liquid crystal molecules, the finally displayed brightness G of this pixel structure will deviate from the brightness X that is supposed to be displayed due to the parasitic effect within this pixel structure and leakage effect of the storage capacitor. In the application of frame inversion, the brightness G may be simply expressed as $G=X-b*Y$, where b is the coefficient of the unit time, and b is related to the time difference from the time when the voltage level of the common voltage is changed to the time when the pixel structure is enabled. Therefore, the greater time difference between the time when the voltage level of the common voltage is changed and the time when the pixel structure is enabled, the greater b is obtained. In other words, the longer time the pixel waits to be enabled after the voltage level of the common voltage is changed, the greater amount of brightness change is generated.

In the embodiments of the invention, by configuring multiple common electrodes and providing multiple common voltage, and changing the voltage level of the common voltages at different time, the time difference between the time when the voltage level of the common voltage is changed and the time when the gate signal/pixel structure is enabled. In this manner, the aforementioned screen flicker problem caused due to a portion of pixels which have to wait for a long time to be enabled may be solved or mitigated. For example, in the embodiment of configuring two common electrodes and two common voltages for frame inversion, as compared to the case of configuring only one common electrode and one common voltage, the amount of brightness change in the latest enabled pixel structure may be effectively halved.

In addition, referring back to FIG. 3, after changing the voltage level of the common voltages, the common voltage generating circuit 110 is further configured to maintain the voltage level of the common voltages V_VCOM1 and V_VCOM2 for a predetermined period, and a length of the predetermined period is equal to a length of a frame period Frame_Period. As shown in FIG. 3, after the common voltage generating circuit 110 changes the voltage level of the common voltage V_VCOM1 at the first time T1, the common voltage generating circuit 110 further maintains the voltage level of the common voltage V_VCOM1 at the high voltage level for a first predetermined period, where a length of the first predetermined period is equal to a length of a frame period Frame_Period, and after the common voltage generating circuit 110 changes the voltage level of the common voltage V_VCOM2 at the second time T2, the common voltage generating circuit 110 further maintains the voltage level of the common voltage V_VCOM2 at the high voltage level for a second predetermined period, where a length of the second predetermined period is also equal to a length of a frame period Frame_Period. That is, the voltage level of the common voltage V_VCOM2 is maintained at high voltage level until half of the frame period Frame_Period of the next frame. After respectively maintaining the voltage level of the common voltages V_VCOM1 and V_VCOM2 for a time period having a length equal to one frame period Frame_Period, the common voltage generating circuit 110 is configured to change the voltage level of the common voltages V_VCOM1 and V_VCOM2 again, for example, changing from high voltage level to low voltage level, for achieving the effect of frame inversion.

In addition, as shown in FIG. 3, in the first embodiment of the invention, the first gate line group comprises the gate lines G(1)~G(M/2), the second gate line group comprises the gate lines G(M/2+1)~G(M), and the gate driving circuit 130 is configured to sequentially output, from the first gate line G(1), the corresponding first gate signals, such as the gate signals SG(1)~SG(M/2) shown in the figure, to the gate lines G(1)~G(M/2) according to an order of increasing gate line indices, and control the level of the first gate signals to be sequentially set to the enable level according to the order of increasing gate line indices, so that the gate lines G(1)~G(M/2) in the first gate line group will be sequentially enabled according to the order of increasing gate line indices in response to the enable level of the first gate signals. Then, the gate driving circuit 130 is configured to sequentially output, from the $(M/2+1)^{th}$ gate line G(M/2+1), the corresponding second gate signals, such as the gate signals SG(M/2+1)~SG(M) shown in the figure, to the gate lines G(M/2+1)~G(M) according to an order of increasing gate line indices, and control the level of the second gate signals to be sequentially set to the enable level according to the order of increasing gate line indices, so that the gate lines G(M/2+1)~G(M) in the second gate line group will be sequentially enabled according to the order of increasing gate line indices in response to the enable level of the second gate signals.

As in the second embodiment of the invention, the gate driving circuit 130 is configured to output the gate signals in different orders for different gate line groups, thereby further reducing the brightness difference between the pixel structures at the junction of different gate line groups.

Figure 4:
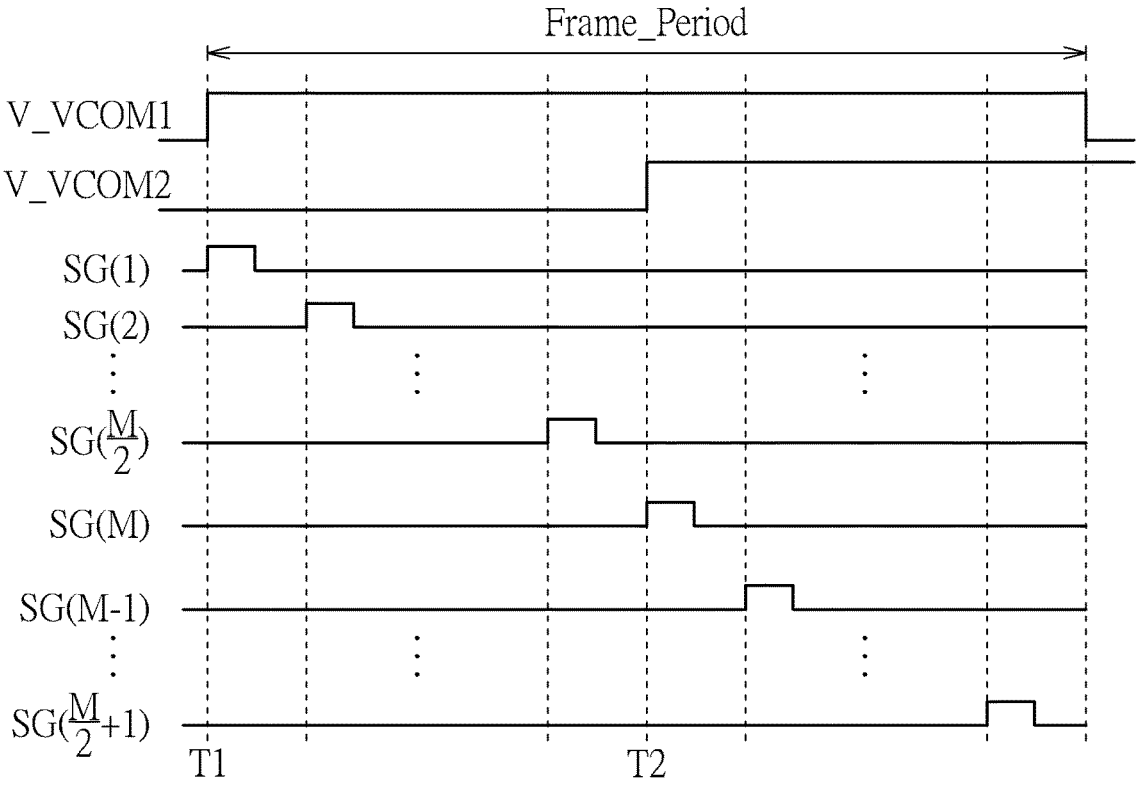
FIG. 4 is a diagram showing the timing of voltages and signals applied to the common electrodes showing in the FIG. 2 according to a second embodiment of the invention.

FIG. 4 is a diagram showing the timing of voltages and signals according to the second embodiment of the invention, which is the exemplary timing of the common voltages and the gate signals applied to the display panel having two common electrodes. Similar to the aforementioned first embodiment, in this embodiment, in a frame period Frame_Period, the common voltage generating circuit 110 is configured to change the voltage level, for example, changing from low voltage level to high voltage level, of the common voltage V_VCOM1 at the first time T1, and configured to change the voltage level, for example, changing from low voltage level to high voltage level, of the common voltage V_VCOM2 at the second time T2, where the first time T1 is different from the second time T2. In addition, after changing the voltage level of the common voltages, the common voltage generating circuit 110 is further configured to maintain the voltage level of the common voltages V_VCOM1 and V_VCOM2 for a predetermined period, and a length of the predetermined period is equal to a length of a frame period Frame_Period, for achieving the effect of frame inversion. Via such driving circuit configuration and the corresponding driving method, as compared to the conventional display panel implementing frame inversion, the amount of brightness change in the latest enabled pixel structure may be effectively halved.

In addition, in this embodiment, the gate driving circuit 130 is configured to sequentially output a plurality of first gate signals, such as the gate signals SG(1)~SG(M/2), to the gate lines, such as the gate lines G(1)~G(M/2), in the first gate line group according to a first order and sequentially output a plurality of second gate signals, such as the gate signals SG(M/2+1)~SG(M), to the gate lines, such as the gate lines G(M/2+1)~G(M), in the second gate line group according to a second order. However, different from the aforementioned first embodiment, in this embodiment of the invention, the first order is different from the second order.

As shown in the figure, in the second embodiment of the invention, the gate driving circuit 130 is configured to sequentially output, from the first gate line G(1), the corresponding first gate signals, such as the gate signals SG(1)~SG(M/2), to the gate lines G(1)~G(M/2) according to an order of increasing gate line indices, and control the level of the first gate signals to be sequentially set to the enable level according to the order of increasing gate line indices, so that the gate lines G(1)~G(M/2) in the first gate line group will be sequentially enabled according to the order of increasing gate line indices in response to the enable level of the first gate signals. Then, the gate driving circuit 130 is configured to sequentially output, from the last gate line G(M), the corresponding second gate signals, such as the gate signals SG(M)~SG(M/2+1), to the gate lines G(M)~G(M/2+1) according to an order of decreasing gate line indices, and control the level of the second gate signals to be sequentially set to the enable level according to the order of decreasing gate line indices, so that the gate lines G(M/2+1)~G(M) in the second gate line group will be sequentially enabled from the last gate line G(M) according to the order of decreasing gate line indices in response to the enable level of the second gate signals.

Since the last gate line G(M/2) in the first gate line group and the first gate line G(M/2+1) in the second gate line group are adjacent to each other and are respectively the latest enabled gate line in the corresponding gate line group, under the configuration in which the amounts of gate lines in two gate line groups are the same or substantially the same, the adjacent two gate lines G(M/2) and G(M/2+1) have similar time waiting to be enabled (that is, the aforementioned time difference between the time when the voltage level of the corresponding common voltage is changed and the time when the gate line is enabled). In this manner, the brightness difference between the pixel structures at the junction of the first gate line group and the second gate line group may be effectively reduced.

The above embodiments describe the driving circuit and driving method of a display module configuring two common electrodes and two common voltages for a display panel. However, the invention is not limited to the configuration of two common electrodes and two common voltages.

Figure 5:
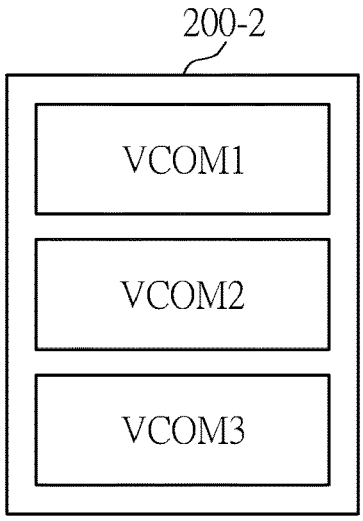
FIG. 5 is a schematic diagram showing the distribution of common electrodes according to another embodiment of the invention.

FIG. 5 is a schematic diagram showing the distribution of common electrodes according to another embodiment of the invention. In this embodiment, there are three common electrodes VCOM1, VCOM2 and VCOM3 configured in the display panel 200-2. The common electrodes VCOM1, VCOM2 and VCOM3 are independent and disconnected from each other. The plurality of pixel structures of the display panel 200-2 are accordingly grouped into a first pixel group, a second pixel group and a third pixel group. The pixel structures in the first pixel group are coupled to the common electrode VCOM1, the pixel structures in the second pixel group are coupled to the common electrode VCOM2 and the pixel structures in the third pixel group are coupled to the common electrode VCOM3. For example, the common electrode VCOM coupled to the pixel structures that are connected to the gate lines G(1)~G(M/3) in FIG. 1 may be the common electrode VCOM1 in FIG. 5, the common electrode VCOM coupled to the pixel structures that are connected to the gate lines G(M/3+1)~G(2M/3) in FIG. 1 may be the common electrode VCOM2 in FIG. 5, and the common electrode VCOM coupled to the pixel structures that are connected to the gate lines G(2M/3+1)~G(M) in FIG. 1 may be the common electrode VCOM3 in FIG. 5.

In this application, the common voltages generated by the common voltage generating circuit 110 comprise the common voltages V_VCOM1, V_VCOM2 and V_VCOM3. The common voltage V_VCOM1 is provided to the common electrode VCOM1, the common voltage V_VCOM2 is provided to the common electrode VCOM2 and the common voltage V_VCOM3 is provided to the common electrode VCOM3. In addition, in this application, the gate lines in the display panel are grouped into a plurality of gate line groups, including a first gate line group, a second gate line group and a third gate line group.

Figure 6:
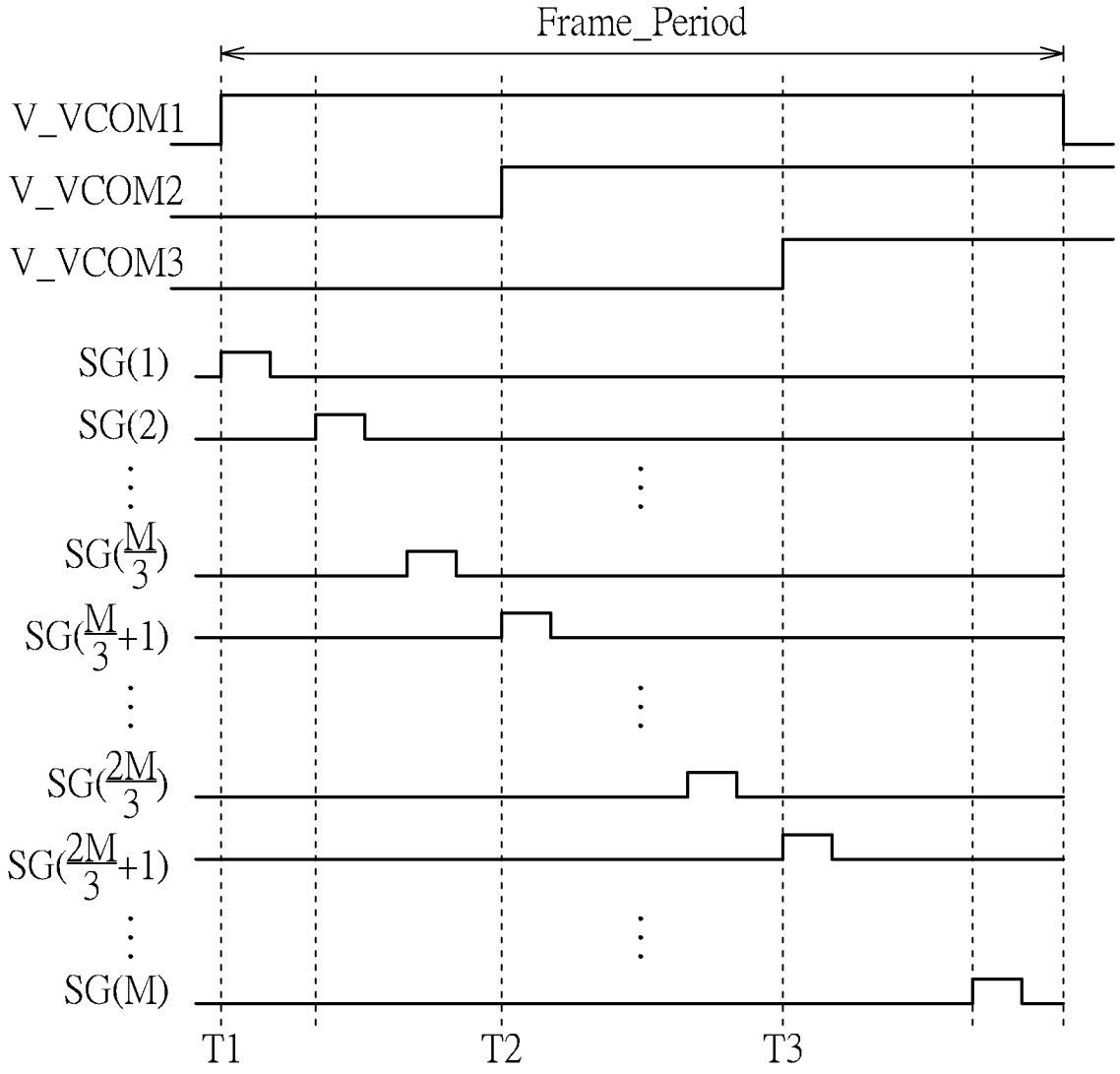
FIG. 6 is a diagram showing the timing of voltages and signals applied to the common electrodes showing in the FIG. 5 according to a third embodiment of the invention.

FIG. 6 is a diagram showing the timing of voltages and signals according to a third embodiment of the invention, which is the exemplary timing of the common voltages and the gate signals applied to the display panel having three common electrodes. As shown in the figure, in a frame period Frame_Period, the common voltage generating circuit 110 is configured to change the voltage level, for example, changing from low voltage level to high voltage level, of the common voltage V_VCOM1 at the first time T1, configured to change the voltage level, for example, changing from low voltage level to high voltage level, of the common voltage V_VCOM2 at the second time T2 and configured to change the voltage level, for example, changing from low voltage level to high voltage level, of the common voltage V_VCOM3 at the third time T3, and the first time T1, the second time T2 and the third time T3 are all different. In addition, after changing the voltage level of the common voltages, the common voltage generating circuit 110 is further configured to respectively maintain the voltage level of the common voltages V_VCOM1, V_VCOM2 and V_VCOM3 for a predetermined period, and a length of the predetermined period is equal to a length of a frame period Frame_Period. For example, the common voltage generating circuit 110 may maintain the high voltage level of the common voltage V_VCOM1 until the end of the current frame period Frame_Period, maintain the high voltage level of the common voltage V_VCOM2 until the time that is at one third of the frame period Frame_Period of the next frame, and maintain the high voltage level of the common voltage V_VCOM3 until the time that is at two third of the frame period Frame_Period of the next frame. After respectively maintaining the voltage level of the common voltages V_VCOM1, V_VCOM2 and V_VCOM3 for a time period having a length equal to one frame period Frame_Period, the common voltage generating circuit 110 is configured to change the voltage level of the common voltages V_VCOM1, V_VCOM2 and V_VCOM3 again, for example, changing from high voltage level to low voltage level, for achieving the effect of frame inversion.

In addition, in this embodiment, the gate driving circuit 130 is configured to sequentially output a plurality of first gate signals, such as the gate signals SG(1)~SG(M/3), to the gate lines, such as the gate lines G(1)~G(M/3), in the first gate line group according to a first order, sequentially output a plurality of second gate signals, such as the gate signals SG(M/3+1)~SG(2M/3), to the gate lines, such as the gate lines G(M/3+1)~G(2M/3), in the second gate line group according to a second order and sequentially output a plurality of third gate signals, such as the gate signals SG(2M/3+1)~SG(M), to the gate lines, such as the gate lines G(2M/3+1)~G(M), in the third gate line group according to a third order. In the third embodiment of the invention, the first order, the second order and the third order are the same.

As shown in FIG. 6, in the third embodiment of the invention, the gate driving circuit 130 is configured to sequentially output, from the first gate line G(1), the corresponding first gate signals, such as the gate signals SG(1)~SG(M/3), to the gate lines G(1)~G(M/3) according to an order of increasing gate line indices, and control the level of the first gate signals to be sequentially set to the enable level according to the order of increasing gate line indices, so that the gate lines G(1)~G(M/3) in the first gate line group will be sequentially enabled according to the order of increasing gate line indices in response to the enable level of the first gate signals. Then, the gate driving circuit 130 is configured to sequentially output, from the $(M/3+1)^{th}$ gate line G(M/3+1), the corresponding second gate signals, such as the gate signals SG(M/3+1)~SG(2M/3), to the gate lines G(M/3+1)~G(2M/3) according to an order of increasing gate line indices, and control the level of the second gate signals to be sequentially set to the enable level according to the order of increasing gate line indices, so that the gate lines G(M/3+1)~G(2M/3) in the second gate line group will be sequentially enabled according to the order of increasing gate line indices in response to the enable level of the second gate signals. Then, the gate driving circuit 130 is configured to sequentially output, from the $(2M/3+1)^{th}$ gate line G(2M/3+1), the corresponding third gate signals, such as the gate signals SG(2M/3+1)~SG(M), to the gate lines G(2M/3+1)~G(M) according to an order of increasing gate line indices, and control the level of the third gate signals to be sequentially set to the enable level according to the order of increasing gate line indices, so that the gate lines G(2M/3+1)~G(M) in the third gate line group will be sequentially enabled according to the order of increasing gate line indices in response to the enable level of the third gate signals.

Figure 7:
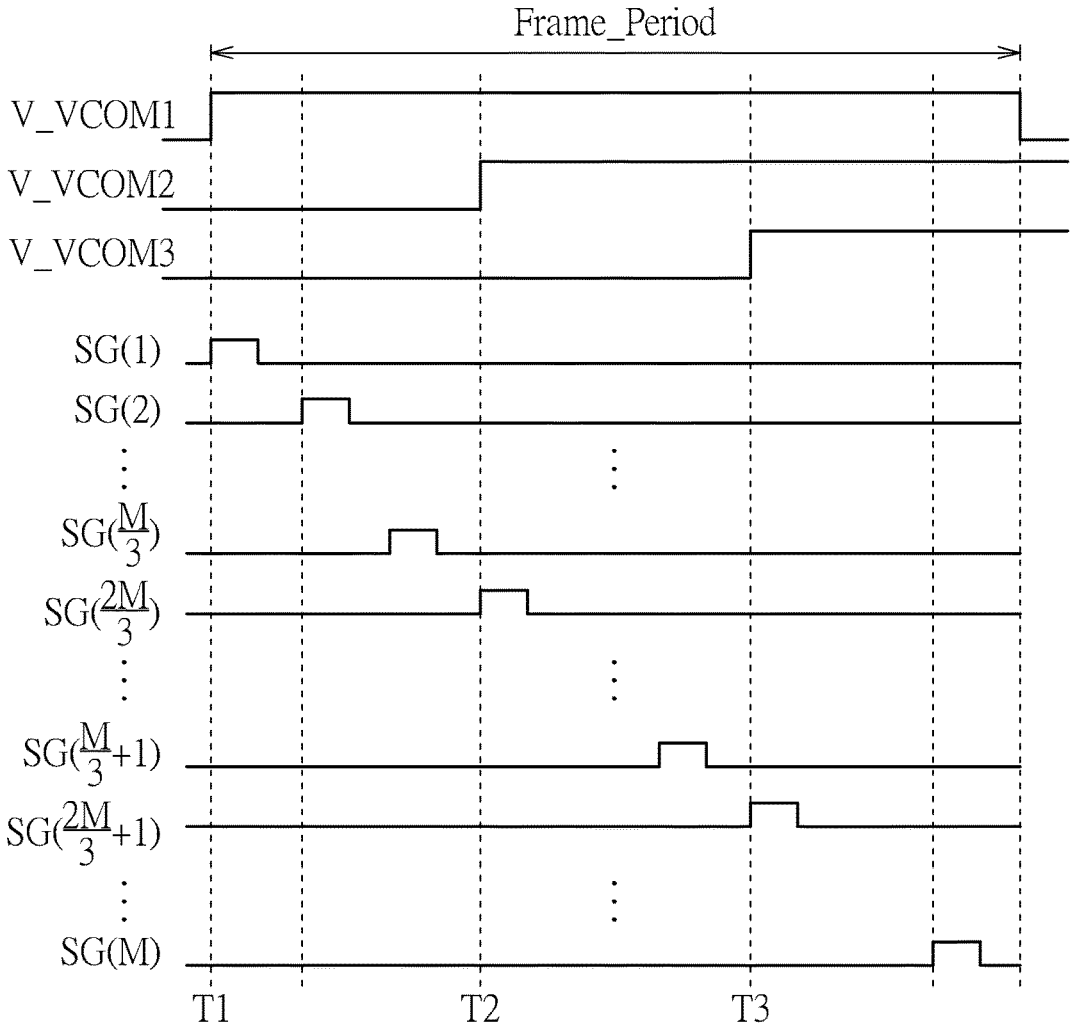
FIG. 7 is a diagram showing the timing of voltages and signals applied to the common electrodes showing in the FIG. 5 according to a fourth embodiment of the invention.

FIG. 7 is a diagram showing the timing of voltages and signals according to a fourth embodiment of the invention, which is also the exemplary timing of the common voltages and the gate signals applied to the display panel having three common electrodes. In this example, the operations of the common voltage generating circuit 110, the configurations of the common electrodes, common voltages and gate line groups, and the timing control of when to change the voltage level of the common voltages are the same as the example shown in FIG. 6, thus the illustrations are omitted here for brevity.

In this embodiment, the first order is different from the second order and the second order is different from the third order.

As shown in the figure, in the fourth embodiment of the invention, the gate driving circuit 130 is configured to sequentially output, from the first gate line G(1), the corresponding first gate signals, such as the gate signals SG(1)~SG(M/3), to the gate lines G(1)~G(M/3) according to an order of increasing gate line indices, and control the level of the first gate signals to be sequentially set to the enable level according to the order of increasing gate line indices, so that the gate lines G(1)~G(M/3) in the first gate line group will be sequentially enabled from the first gate line G(1) according to the order of increasing gate line indices in response to the enable level of the first gate signals. Then, the gate driving circuit 130 is configured to sequentially output, from the $(2M/3)^{th}$ gate line G(2M/3), the corresponding second gate signals, such as the gate signals SG(2M/3)~SG(M/3+1), to the gate lines G(2M/3)~G(M/3+1) according to an order of decreasing gate line indices, and control the level of the second gate signals to be sequentially set to the enable level according to the order of decreasing gate line indices, so that the gate lines G(M/3+1)~G(2M/3) in the second gate line group will be sequentially enabled from the last gate line G(2M/3) in this gate line group according to the order of decreasing gate line indices in response to the enable level of the second gate signals. Then, the gate driving circuit 130 is configured to sequentially output, from the $(2M/3+1)^{th}$ gate line G(2M/3+1), the corresponding third gate signals, such as the gate signals SG(2M/3+1)~SG(M), to the gate lines G(2M/3+1)~G(M) according to an order of increasing gate line indices, and control the level of the third gate signals to be sequentially set to the enable level according to the order of increasing gate line indices, so that the gate lines G(2M/3+1)~G(M) in the third gate line group will be sequentially enabled from the first gate line G(2M/3+1) in this gate line group according to the order of increasing gate line indices in response to the enable level of the third gate signals.

Since the last gate line G(M/3) in the first gate line group and the first gate line G(M/3+1) in the second gate line group are adjacent to each other and are respectively the latest enabled gate line in the corresponding gate line group, under the configuration in which the amounts of gate lines in two gate line groups are the same or substantially the same, the adjacent two gate lines G(M/3) and G(M/3+1) have similar time waiting to be enabled (that is, the aforementioned time difference between the time when the voltage level of the corresponding common voltage is changed and the time when the gate line is enabled). In this manner, the brightness difference between the pixel structures at the junction of the first gate line group and the second gate line group may be effectively reduced. Similarly, since the last gate line G(2M/3) in the second gate line group and the first gate line G(2M/3+1) in the third gate line group are adjacent to each other and are respectively the first enabled gate line in the corresponding gate line group, under the configuration in which the amounts of gate lines in two gate line groups are the same or substantially the same, the adjacent two gate lines G(2M/3) and G(2M/3+1) have similar time waiting to be enabled. In this manner, the brightness difference between the pixel structures at the junction of the second gate line group and the third gate line group may be effectively reduced.

Figure 8:
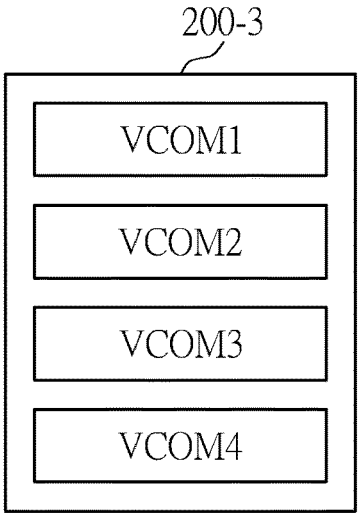
FIG. 8 is a schematic diagram showing the distribution of common electrodes according to yet another embodiment of the invention.

FIG. 8 is a schematic diagram showing the distribution of common electrodes according to yet another embodiment of the invention. In this embodiment, there are four common electrodes VCOM1, VCOM2, VCOM3 and VCOM4 configured in the display panel 200-3. The common electrodes VCOM1, VCOM2, VCOM3 and VCOM4 are independent and disconnected from each other. The plurality of pixel structures of the display panel 200-3 are accordingly grouped into a first pixel group, a second pixel group, a third pixel group and a fourth pixel group. The pixel structures in the first pixel group are coupled to the common electrode VCOM1, the pixel structures in the second pixel group are coupled to the common electrode VCOM2, the pixel structures in the third pixel group are coupled to the common electrode VCOM3 and the pixel structures in the fourth pixel group are coupled to the common electrode VCOM4. For example, the common electrode VCOM coupled to the pixel structures that are connected to the gate lines G(1)~G(M/4) in FIG. 1 may be the common electrode VCOM1 in FIG. 8, the common electrode VCOM coupled to the pixel structures that are connected to the gate lines G(M/4+1)~G(2M/4) in FIG. 1 may be the common electrode VCOM2 in FIG. 8, the common electrode VCOM coupled to the pixel structures that are connected to the gate lines G(2M/4+1)~G(3M/4) in FIG. 1 may be the common electrode VCOM3 in FIG. 8 and the common electrode VCOM coupled to the pixel structures that are connected to the gate lines G(3M/4+1)~G(M) in FIG. 1 may be the common electrode VCOM4 in FIG. 8.

Figure 9:
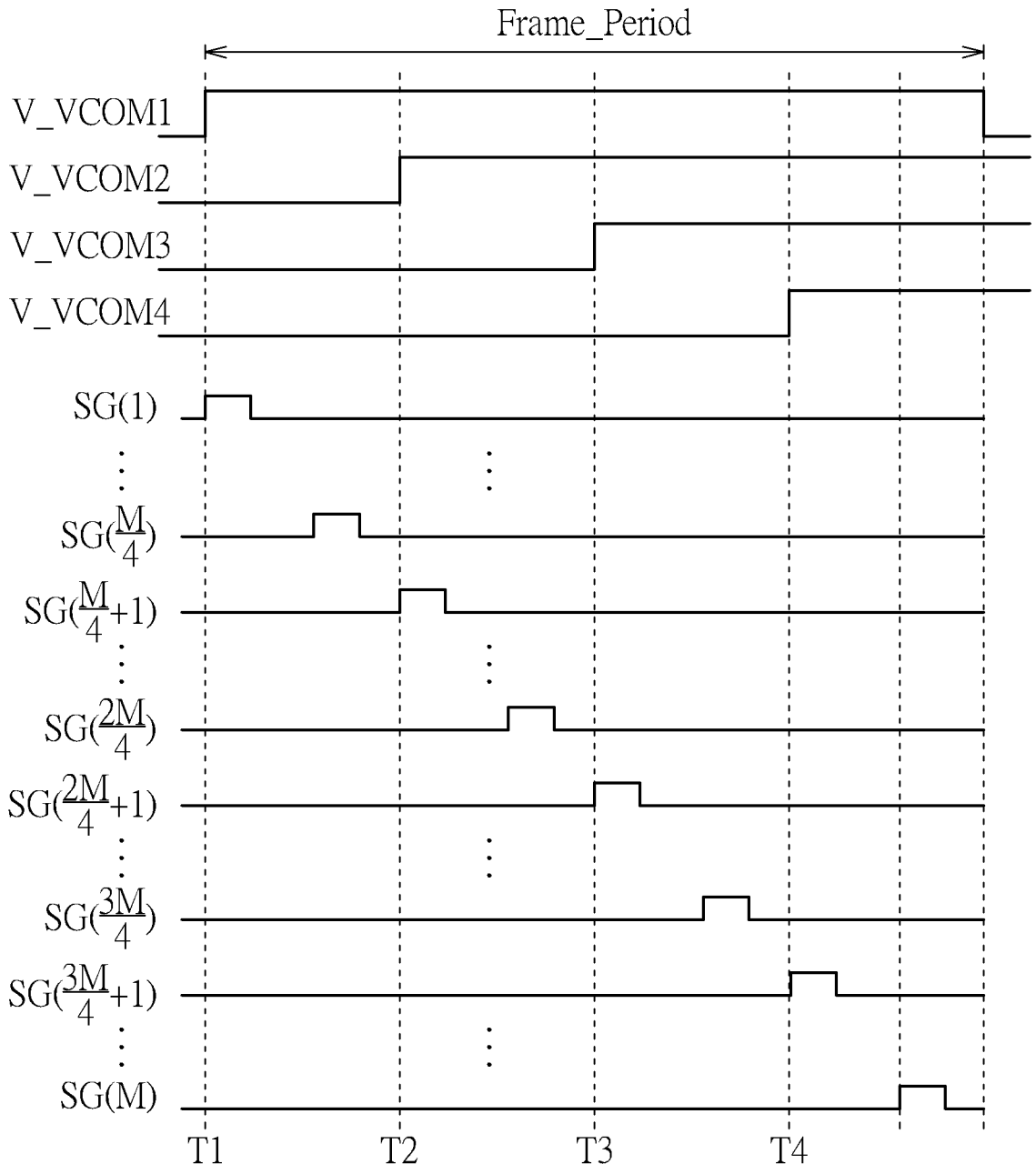
FIG. 9 is a diagram showing the timing of voltages and signals applied to the common electrodes showing in the FIG. 8 according to a fifth embodiment of the invention.

FIG. 9 is a diagram showing the timing of voltages and signals according to a fifth embodiment of the invention, which is the exemplary timing of the common voltages and the gate signals applied to the display panel having four common electrodes. As shown in the figure, in a frame period Frame_Period, the common voltage generating circuit 110 is configured to change the voltage level, for example, changing from low voltage level to high voltage level, of the common voltage V_VCOM1 at the first time T1, configured to change the voltage level, for example, changing from low voltage level to high voltage level, of the common voltage V_VCOM2 at the second time T2, configured to change the voltage level, for example, changing from low voltage level to high voltage level, of the common voltage V_VCOM3 at the third time T3, and configured to change the voltage level, for example, changing from low voltage level to high voltage level, of the common voltage V_VCOM4 at the fourth time T4, and the first time T1, the second time T2, the third time T3 and the fourth time T4 are all different.

In addition, after changing the voltage level of the common voltages, the common voltage generating circuit 110 is further configured to respectively maintain the voltage level of the common voltages V_VCOM1, V_VCOM2, V_VCOM3 and V_VCOM4 for a predetermined period, and a length of the predetermined period is equal to a length of a frame period Frame_Period. For example, the common voltage generating circuit 110 may maintain the high voltage level of the common voltage V_VCOM1 until the end of the current frame period Frame_Period, maintain the high voltage level of the common voltage V_VCOM2 until the time that is at one fourth of the frame period Frame_Period of the next frame, maintain the high voltage level of the common voltage V_VCOM3 until the time that is at two fourth of the frame period Frame_Period of the next frame and maintain the high voltage level of the common voltage V_VCOM4 until the time that is at third fourth of the frame period Frame_Period of the next frame. After respectively maintaining the voltage level of the common voltages V_VCOM1, V_VCOM2, V_VCOM3 and V_VCOM4 for a time period having a length equal to one frame period Frame_Period, the common voltage generating circuit 110 is configured to change the voltage level of the common voltages V_VCOM1, V_VCOM2, V_VCOM3 and V_VCOM43 again, for example, changing from high voltage level to low voltage level, for achieving the effect of frame inversion.

In addition, in this embodiment, the gate driving circuit 130 is configured to sequentially output a plurality of first gate signals to the gate lines, such as the gate lines G(1)~G(M/4), in the first gate line group according to a first order, sequentially output a plurality of second gate signals to the gate lines, such as the gate lines G(M/4+1)~G(2M/4), in the second gate line group according to a second order, sequentially output a plurality of third gate signals to the gate lines, such as the gate lines G(2M/4+1)~G(3M/4), in the third gate line group according to a third order and sequentially output a plurality of fourth gate signals to the gate lines, such as the gate lines G(3M/4+1)~G(M), in the fourth gate line group according to a fourth order. In the fifth embodiment of the invention, the first order, the second order, the third order and the fourth order are the same.

As shown in FIG. 9, in the fifth embodiment of the invention, the gate driving circuit 130 is configured to sequentially output, from the first gate line G(1), the corresponding first gate signals, such as the gate signals SG(1)~SG(M/4), to the gate lines G(1)~G(M/4) according to an order of increasing gate line indices, and control the level of the first gate signals to be sequentially set to the enable level according to the order of increasing gate line indices, so that the gate lines G(1)~G(M/4) in the first gate line group will be sequentially enabled according to the order of increasing gate line indices in response to the enable level of the first gate signals. Then, the gate driving circuit 130 is configured to sequentially output, from the $(M/4+1)^{th}$ gate line G(M/4+1), the corresponding second gate signals, such as the gate signals SG(M/4+1)~SG(2M/4), to the gate lines G(M/4+1)~G(2M/4) according to an order of increasing gate line indices, and control the level of the second gate signals to be sequentially set to the enable level according to the order of increasing gate line indices, so that the gate lines G(M/4+1)~G(2M/4) in the second gate line group will be sequentially enabled according to the order of increasing gate line indices in response to the enable level of the second gate signals. Then, the gate driving circuit 130 is configured to sequentially output, from the $(2M/4+1)^{th}$ gate line G(2M/4+1), the corresponding third gate signals, such as the gate signals SG(2M/4+1)~SG(3M/4), to the gate lines G(2M/4+1)~G(3M/4) according to an order of increasing gate line indices, and control the level of the third gate signals to be sequentially set to the enable level according to the order of increasing gate line indices, so that the gate lines G(2M/4+1)~G(3M/4) in the third gate line group will be sequentially enabled according to the order of increasing gate line indices in response to the enable level of the third gate signals. Then, the gate driving circuit 130 is configured to sequentially output, from the $(3M/4+1)^{th}$ gate line G(3M/4+1), the corresponding fourth gate signals, such as the gate signals SG(3M/4+1)~SG(M), to the gate lines G(3M/4+1)~G(M) according to an order of increasing gate line indices, and control the level of the fourth gate signals to be sequentially set to the enable level according to the order of increasing gate line indices, so that the gate lines G(3M/4+1)~G(M) in the fourth gate line group will be sequentially enabled according to the order of increasing gate line indices in response to the enable level of the fourth gate signals.

Figure 10:
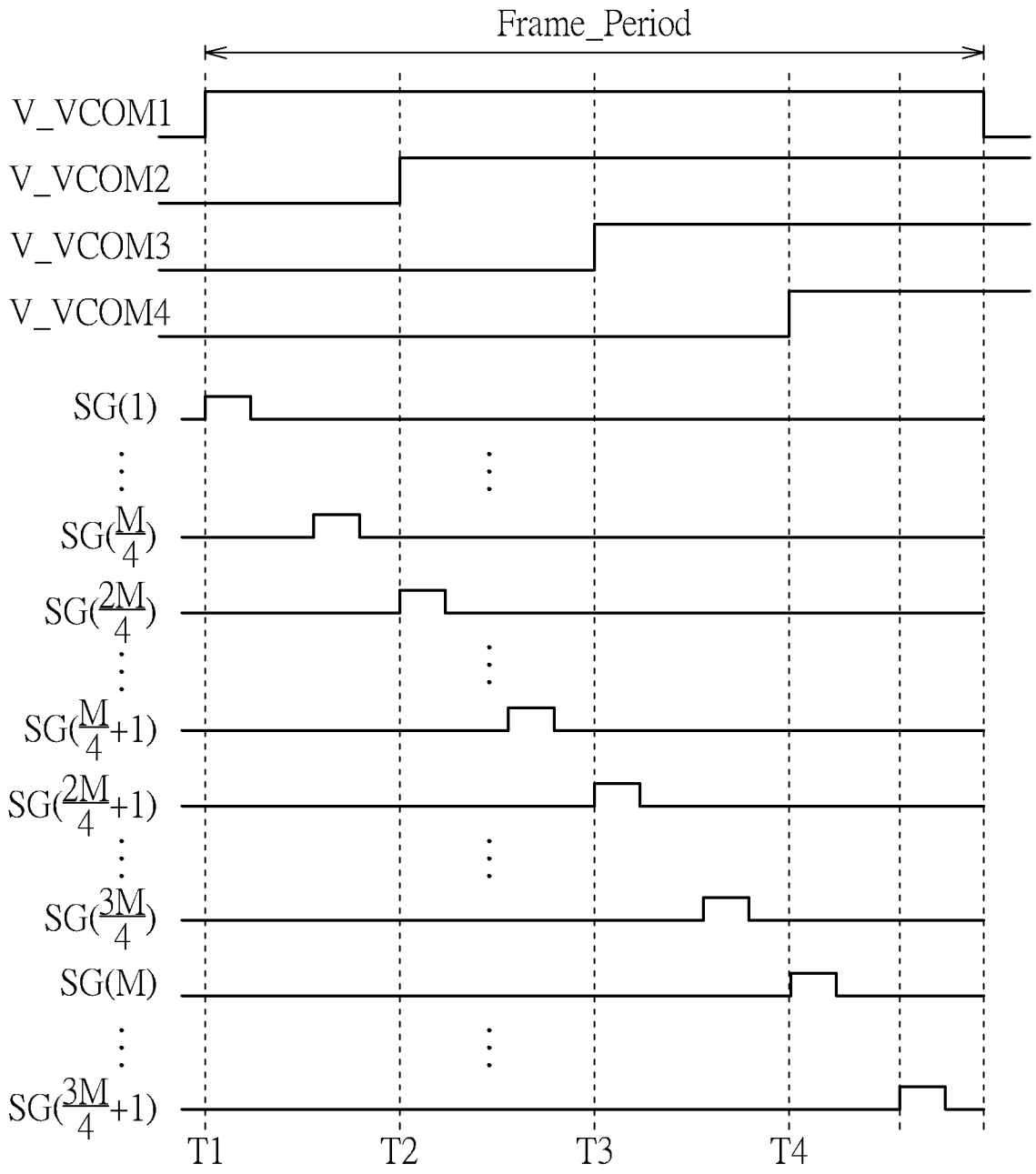
FIG. 10 is a diagram showing the timing of voltages and signals applied to the common electrodes showing in the FIG. 8 according to a sixth embodiment of the invention.

FIG. 10 is a diagram showing the timing of voltages and signals according to a sixth embodiment of the invention, which is also the exemplary timing of the common voltages and the gate signals applied to the display panel having four common electrodes. In this example, the operations of the common voltage generating circuit 110, the configurations of the common electrodes, common voltages and gate line groups, and the timing control of when to change the voltage level of the common voltages are the same as the example shown in FIG. 9, thus the illustrations are omitted here for brevity.

In this embodiment, the first order is different from the second order, the second order is different from the third order and the third order is different from the fourth order.

As shown in the figure, in the sixth embodiment of the invention, the gate driving circuit 130 is configured to sequentially output, from the first gate line G(1), the corresponding first gate signals, such as the gate signals SG(1)~SG(M/4), to the gate lines G(1)~G(M/4) according to an order of increasing gate line indices, and control the level of the first gate signals to be sequentially set to the enable level according to the order of increasing gate line indices, so that the gate lines G(1)~G(M/4) in the first gate line group will be sequentially enabled from the first gate line G(1) according to the order of increasing gate line indices in response to the enable level of the first gate signals. Then, the gate driving circuit 130 is configured to sequentially output, from the $(2M/4)^{th}$ gate line G(2M/4), the corresponding second gate signals, such as the gate signals SG(2M/4)~SG(M/4+1), to the gate lines G(2M/4)~G(M/4+1) according to an order of decreasing gate line indices, and control the level of the second gate signals to be sequentially set to the enable level according to the order of decreasing gate line indices, so that the gate lines G(M/4+1)~G(2M/4) in the second gate line group will be sequentially enabled from the last gate line G(2M/4) in this gate line group according to the order of decreasing gate line indices in response to the enable level of the second gate signals. Then, the gate driving circuit 130 is configured to sequentially output, from the $(2M/4+1)^{th}$ gate line G(2M/4+1), the corresponding third gate signals, such as the gate signals SG(2M/4+1)~SG(3M/4), to the gate lines G(2M/4+1)~G(3M/4) according to an order of increasing gate line indices, and control the level of the third gate signals to be sequentially set to the enable level according to the order of increasing gate line indices, so that the gate lines G(2M/4+1)~G(3M/4) in the third gate line group will be sequentially enabled from the first gate line G(2M/4+1) in this gate line group according to the order of increasing gate line indices in response to the enable level of the third gate signals. Then, the gate driving circuit 130 is configured to sequentially output, from the $M^{th}$ gate line G(M), the corresponding fourth gate signals, such as the gate signals SG(M)~SG(3M/4+1), to the gate lines G(M)~G(3M/4+1) according to an order of decreasing gate line indices, and control the level of the fourth gate signals to be sequentially set to the enable level according to the order of decreasing gate line indices, so that the gate lines G(3M/4+1)~G(M) in the fourth gate line group will be sequentially enabled from the last gate line G(M) in this gate line group according to the order of decreasing gate line indices in response to the enable level of the fourth gate signals.

Since the last gate line G(M/4) in the first gate line group and the first gate line G(M/4+1) in the second gate line group are adjacent to each other and are respectively the latest enabled gate line in the corresponding gate line group, under the configuration in which the amounts of gate lines in two gate line groups are the same or substantially the same, the adjacent two gate lines G(M/4) and G(M/4+1) have similar time waiting to be enabled (that is, the aforementioned time difference between the time when the voltage level of the corresponding common voltage is changed and the time when the gate line is enabled). In this manner, the brightness difference between the pixel structures at the junction of the first gate line group and the second gate line group may be effectively reduced. Similarly, since the last gate line G(2M/4) in the second gate line group and the first gate line G(2M/4+1) in the third gate line group are adjacent to each other and are respectively the first enabled gate line in the corresponding gate line group, under the configuration in which the amounts of gate lines in two gate line groups are the same or substantially the same, the adjacent two gate lines G(2M/4) and G(2M/4+1) have similar time waiting to be enabled. In this manner, the brightness difference between the pixel structures at the junction of the second gate line group and the third gate line group may be effectively reduced. Similarly, since the last gate line G(3M/4) in the third gate line group and the first gate line G(3M/4+1) in the fourth gate line group are adjacent to each other and are respectively the latest enabled gate line in the corresponding gate line group, under the configuration in which the amounts of gate lines in two gate line groups are the same or substantially the same, the adjacent two gate lines G(3M/4) and G(3M/4+1) have similar time waiting to be enabled. In this manner, the brightness difference between the pixel structures at the junction of the third gate line group and the fourth gate line group may be effectively reduced.

It should be noted that, in the embodiments of the invention, the total number M of the gate lines may be a multiple of 2, a multiple of 3 or a multiple of 4. However, the invention should not be limited thereto. For example, in some embodiments of the invention, when the aforementioned index M/2, M/3 or M/4 of the gate lines are not integers, the integers closest to the values M/2, M/3 or M/4 may be selected as the index of the corresponding gate lines.

In addition, it should be noted that, although in the embodiments of the invention the pixels are equally divided into a plurality of pixel groups according to the number of common electrodes/common voltages, so as to configure the distribution of the plurality of common electrodes, the invention should not be limited thereto. When configuring the distribution of the plurality of common electrodes, the size of each pixel group (that is, the number of pixel structures in each pixel group) may be different.

In addition, it should be noted that, although the above paragraphs are described by using four or less common electrodes and common voltages as examples, the invention should not be limited to this. Those skilled in the art can derive the driving circuit and driving method with more than four common electrodes and common voltages based on the disclosure of this specification. In the embodiment of the invention, the number of the common electrodes and the common voltages may be a positive integer between 2 and M.

Figure 11:
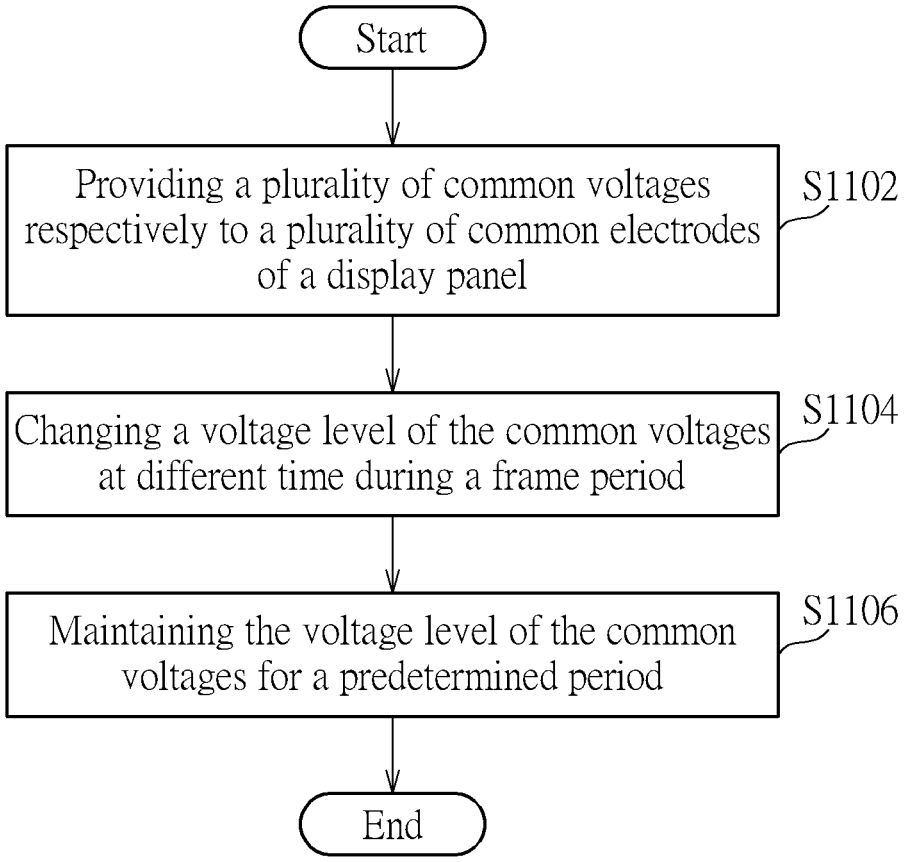
FIG. 11 is a flow chart of a driving method for driving a display panel according to an embodiment of the invention.

FIG. 11 is a flow chart of a driving method for driving a display panel according to an embodiment of the invention, comprising the following steps:

Step S1102: providing a plurality of common voltages respectively to a plurality of common electrodes of a display panel by a common voltage generating circuit.

Step S1104: changing a voltage level of the common voltages at different time during a frame period by the common voltage generating circuit.

Step S1106: maintaining the voltage level of the common voltages for a predetermined period after changing the voltage level of the common voltages.

Steps S1104 and S1106 may be repeatedly performed in each frame period, and for some common voltages, the predetermined period for maintaining the voltage level thereof may across adjacent two frames. For example, the voltage level of the common voltage may be maintained from a predetermined time in a frame period to another predetermined time in a next frame period.

In the embodiments of the invention, there may be a variety of different implementations of the method for controlling the voltage level of the common voltages and the change time thereof. For example, there may be one or more registers configured in the common voltage generating circuit 110 for storing the aforementioned control parameters. The control parameters respectively indicates at which time the common voltage generating circuit 110 has to change the voltage level of the common voltage, where the common voltage generating circuit 110 may know the time by counting the number of pulses of the clock signal. The common voltage generating circuit 110 counts the number of pulses of the clock signal according to the control parameters registered in the registers, thereby changing the voltage level of the common voltage at the corresponding time. The clock signal may be provided by the timing control circuit 120, or may be generated by the common voltage generating circuit 110, or may be an external clock signal received by the common voltage generating circuit 110. For another example, the timing control circuit 120 may directly issue corresponding control signals to control the common voltage generating circuit 110 to change the voltage level of the common voltages at different time. The invention is not limited to any specific implementation.

In summary, the proposed display module, driving circuit and driving method for the display panel may effectively solve the flicker problem of the display panel existing in the conventional art when implementing frame invention by configuring a plurality of common electrodes and a plurality of common voltages and changing the voltage level of the common voltages at different time. In addition, in some embodiments of the invention, by controlling the gate driving circuit to output the gate signals to different gate line groups in different orders, the brightness difference between the pixel structures at the junction of these gate line groups may be effectively reduced. In this manner, the brightness distribution of the display panel may be more uniform.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving circuit for a display panel, comprising:

a common voltage generating circuit, coupled to a plurality of common electrodes of the display panel and configured to provide a plurality of common voltages respectively to the common electrodes, wherein during a frame period, the common voltage generating circuit changes a voltage level of the common voltages respectively at different time, wherein the common voltages comprise a first common voltage and a second common voltage, the common electrodes comprise a first common electrode and a second common electrode, the first common voltage is provided to the first common electrode, the second common voltage is provided to the second common electrode, the common voltage generating circuit is configured to change the voltage level of the first common voltage at a first time within the frame period and is configured to change the voltage level of the second common voltage at a second time within the frame period, wherein the first time is different from the second time, and the time difference between the first time and the second time relates to an amount of the common voltages.

2. The driving circuit for the display panel of claim 1, further comprising:

a timing control circuit, coupled to the common voltage generating circuit and configured to control the common voltage generating circuit to change the voltage level of the common voltages.

3. The driving circuit for the display panel of claim 1, wherein after changing the voltage level of the common voltages, the common voltage generating circuit is further configured to maintain the voltage level of the common voltages for a predetermined period, and a length of the predetermined period is equal to a length of a frame period.

4. The driving circuit for the display panel of claim 1, wherein the display panel comprises a plurality of pixel structures, the pixel structures are grouped into a plurality of pixel groups, and the pixel groups are respectively coupled to the common electrodes.

5. The driving circuit for the display panel of claim 1, further comprising:

a gate driving circuit, coupled to a plurality of gate lines of the display panel and configured to output a plurality of gate signals, wherein the gate signals comprise a plurality of first gate signals and a plurality of second gate signals;

wherein the gate lines are grouped into a plurality of gate line groups, the gate line groups comprise a first gate line group and a second gate line group, the gate driving circuit is configured to sequentially output the first gate signals to the gate lines in the first gate line group according to a first order and sequentially output the second gate signals to the gate lines in the second gate line group according to a second order, and the first order is different from the second order.

6. The driving circuit for the display panel of claim 1, wherein after changing the voltage level of the first common voltage and changing the voltage level of the second common voltage, the common voltage generating circuit is further configured to maintain the voltage level of the first common voltage for a first predetermined period and maintain the voltage level of the second common voltage for a second predetermined period, and a length of the first predetermined period and a length of the second predetermined period are equal to a length of a frame period.

7. The driving circuit for the display panel of claim 1, wherein the display panel comprises a plurality of pixel structures, the pixel structures are grouped into a plurality of pixel groups, the pixel groups comprise a first pixel group and a second pixel group, the pixel structures in the first pixel group are coupled to the first common electrode and the pixel structures in the second pixel group are coupled to the second common electrode.

8. The driving circuit for the display panel of claim 1, further comprising:

a source driving circuit, coupled to a plurality of source lines of the display panel and configured to output a plurality of source signals.

9. A driving method for driving a display panel, comprising:

respectively providing a plurality of common voltages to a plurality of common electrodes of a display panel; and changing a voltage level of the common voltages at different time during a frame period, wherein the common voltages comprise a first common voltage and a second common voltage, the common electrodes comprise a first common electrode and a second common electrode, the first common voltage is provided to the first common electrode, the second common voltage is provided to the second common electrode, and step of changing the voltage level of the common voltages at different time during the frame period further comprises:

changing the voltage level of the first common voltage at a first time within the frame period; and changing the voltage level of the second common voltage at a second time within the frame period, wherein the first time is different from the second time, and the time difference between the first time and the second time relates to an amount of the common voltages.

10. The driving method for driving the display panel of claim 9, further comprising:

maintaining the voltage level of the common voltages for a predetermined period after changing the voltage level of the common voltages, wherein a length of the predetermined period is equal to a length of a frame period.

11. The driving method for driving the display panel of claim 9, wherein the display panel comprises a plurality of pixel structures, the pixel structures are grouped into a plurality of pixel groups, and the pixel groups are respectively coupled to the common electrodes.

12. The driving method for driving the display panel of claim 9, wherein the display panel comprises a plurality of gate lines, the gate lines are grouped into a plurality of gate line groups, the gate line groups comprise a first gate line group and a second gate line group, and the driving method for driving the display panel further comprises:

sequentially outputting a plurality of first gate signals to the gate lines in the first gate line group according to a first order; and sequentially outputting a plurality of second gate signals to the gate lines in the second gate line group according to a second order, wherein the first order is different from the second order.

13. The driving method for driving the display panel of claim 9, further comprising:

maintaining the voltage level of the first common voltage for a first predetermined period after changing the voltage level of the first common voltage; and maintaining the voltage level of the second common voltage for a second predetermined period after changing the voltage level of the second common voltage, wherein a length of the first predetermined period and a length of the second predetermined period are equal to a length of a frame period.

14. The driving method for driving the display panel of claim 9, wherein the display panel comprises a plurality of pixel structures, the pixel structures are grouped into a plurality of pixel groups, the pixel groups comprise a first pixel group and a second pixel group, the pixel structures in the first pixel group are coupled to the first common electrode and the pixel structures in the second pixel group are coupled to the second common electrode.

15. The driving method for driving the display panel of claim 9, further comprising:

outputting a plurality of source signals to a plurality of source lines of the display panel.

16. A display module, comprising:

a display panel, comprising a plurality of common electrodes;

a common voltage generating circuit, coupled to the common electrodes and configured to provide a plurality of common voltages respectively to the common electrodes, wherein during a frame period, the common voltage generating circuit changes a voltage level of the common voltages respectively at different time, wherein the common voltages comprise a first common voltage and a second common voltage, the common electrodes comprise a first common electrode and a second common electrode, the first common voltage is provided to the first common electrode, the second common voltage is provided to the second common electrode, the common voltage generating circuit is configured to change the voltage level of the first common voltage at a first time within the frame period and is configured to change the voltage level of the second common voltage at a second time within the frame period, wherein the first time is different from the second time, and the time difference between the first time and the second time relates to an amount of the common voltages.

17. The display module of claim 16, further comprising:

a timing control circuit, coupled to the common voltage generating circuit and configured to control the common voltage generating circuit to change the voltage level of the common voltages.

18. The display module of claim 16, wherein after changing the voltage level of the common voltages, the common voltage generating circuit is further configured to maintain the voltage level of the common voltages for a predetermined period, and a length of the predetermined period is equal to a length of a frame period.

19. The display module of claim 16, wherein the display panel comprises a plurality of pixel structures, the pixel structures are grouped into a plurality of pixel groups, and the pixel groups are respectively coupled to the common electrodes.

20. The display module of claim 16, further comprising:

a gate driving circuit, coupled to a plurality of gate lines of the display panel and configured to output a plurality of gate signals, wherein the gate signals comprise a plurality of first gate signals and a plurality of second gate signals; and a source driving circuit, coupled to a plurality of source lines of the display panel and configured to output a plurality of source signals, wherein the gate lines are grouped into a plurality of gate line groups, the gate line groups comprise a first gate line group and a second gate line group, the gate driving circuit is configured to sequentially output the first gate signals to the gate lines in the first gate line group according to a first order and sequentially output the second gate signals to the gate lines in the second gate line group according to a second order, and the first order is different from the second order.

21. The display module of claim 16, wherein after changing the voltage level of the first common voltage and changing the voltage level of the second common voltage, the common voltage generating circuit is further configured to maintain the voltage level of the first common voltage for a first predetermined period and maintain the voltage level of the second common voltage for a second predetermined period, and a length of the first predetermined period and a length of the second predetermined period are equal to a length of a frame period.

* * * * *